US009078550B2

(12) United States Patent
Pruitt et al.

(10) Patent No.: US 9,078,550 B2
(45) Date of Patent: Jul. 14, 2015

(54) LATCH ASSEMBLY FOR A VACUUM SYSTEM

(75) Inventors: Anthony Pruitt, Normal, IL (US); Raymond E. Clepper, Brooklyn, NY (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 907 days.

(21) Appl. No.: 13/294,424

(22) Filed: Nov. 11, 2011

(65) Prior Publication Data

US 2013/0117958 A1 May 16, 2013

(51) Int. Cl.

| | |
|---|---|
| ***A47L 5/38*** | (2006.01) |
| ***A47L 9/10*** | (2006.01) |
| ***A47L 9/14*** | (2006.01) |

(52) U.S. Cl.

CPC . *A47L 5/38* (2013.01); *A47L 9/106* (2013.01); *A47L 9/1427* (2013.01)

(58) Field of Classification Search

CPC ..... A47L 5/38; A47L 9/106; A47L 9/1427
USPC ..... 15/347, 352, 301
See application file for complete search history.

(56) References Cited

U.S. PATENT DOCUMENTS

| | | | |
|---|---|---|---|
| 2,726,889 | A | 12/1955 | Lawson |
| 2,804,329 | A | 8/1957 | Landis |
| 5,292,158 | A | 3/1994 | Kurosaki |
| 5,370,259 | A | 12/1994 | Cartigny |
| 5,400,463 | A | 3/1995 | Attard et al. |
| 5,404,614 | A | 4/1995 | Stephens |
| 5,737,797 | A | 4/1998 | Rittmueller et al. |
| 6,698,059 | B2 | 3/2004 | Biere et al. |
| 6,712,868 | B2 | 3/2004 | Murphy et al. |
| 6,779,228 | B2 | 8/2004 | Plomteux et al. |
| 7,287,301 | B2 | 10/2007 | Marshall et al. |
| 7,441,813 | B2 | 10/2008 | Qin et al. |

(Continued)

FOREIGN PATENT DOCUMENTS

| | | |
|---|---|---|
| DE | 4031123 | 4/1992 |
| DE | 4031123 A1 | 4/1992 |

(Continued)

OTHER PUBLICATIONS

International Search Report and Written Opinion of PCT/US2012/063805, Blaine R. Copenheaver, Authorized Officer, Issued Jan. 24, 2013.

(Continued)

*Primary Examiner* — David Redding
(74) *Attorney, Agent, or Firm* — RatnerPrestia

(57) ABSTRACT

A central vacuum cleaner having a housing with a vacuum fan and motor and a dirt container mounted to a lower end of the housing. The dirt container includes a receptacle, a ring mount extending from the receptacle sidewall near an open top of the receptacle and a release ring. The ring mount extends around the sidewall perimeter and a bottom of the ring mount is shaped to be held by an operator to support the dirt container. The release ring is movably mounted above the ring mount and extends around the sidewall perimeter. One or more locks are mounted between the ring mount and the release ring. The locks are movable by the release ring from an engaged position to hold the dirt container to the housing to a disengaged position to permit removal of the dirt container from the housing.

24 Claims, 5 Drawing Sheets

(56) References Cited

U.S. PATENT DOCUMENTS

| | | | |
|---|---|---|---|
| 7,461,430 | B2 | 12/2008 | Reick-Mitrisin et al. |
| 2005/0039295 | A1 | 2/2005 | Werning |
| 2006/0150360 | A1 | 7/2006 | Reick-Mitrisin et al. |
| 2008/0016646 | A1 | 1/2008 | Gagnon et al. |
| 2010/0199454 | A1 | 8/2010 | Pruitt et al. |

FOREIGN PATENT DOCUMENTS

| | | | |
|---|---|---|---|
| EP | 1938735 | A2 | 7/2008 |
| EP | 1997411 | | 12/2008 |
| WO | WO 2008/121114 | | 10/2008 |

OTHER PUBLICATIONS

U.S. Appl. No. 13/744,804, filed Jan. 18, 2013; "Central Vacuum Cleaner Apparatus", Anthony Pruitt.

European Search Report Based on EP 10152843.8-2316, Jan. 31, 2013.

International Search Report for PCT Application No. PCT/US2014/11210 dated May 5, 2014.

European Patent Application Office Action for Application No. 10 152 843.8-1712 dated Oct. 31, 2013.

International Preliminary Report on Patentability for PCT International Application No. PCT/US2012/063805 dated May 14, 2015.

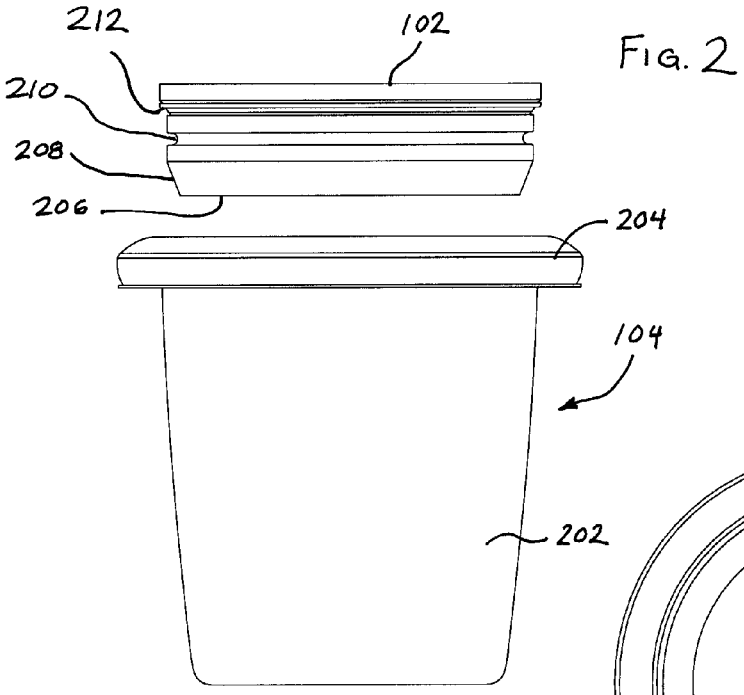
FIG. 2
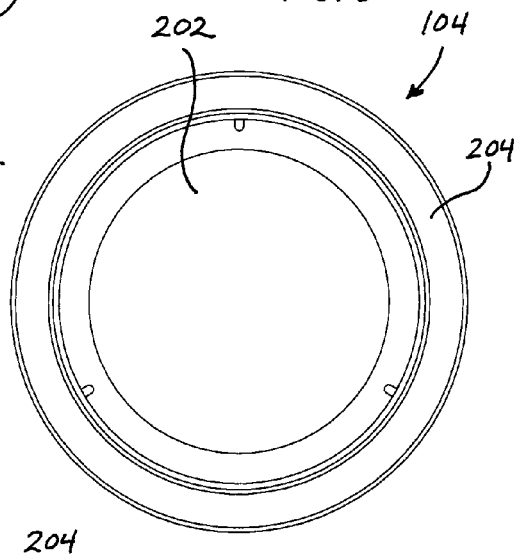
FIG. 3
FIG. 4
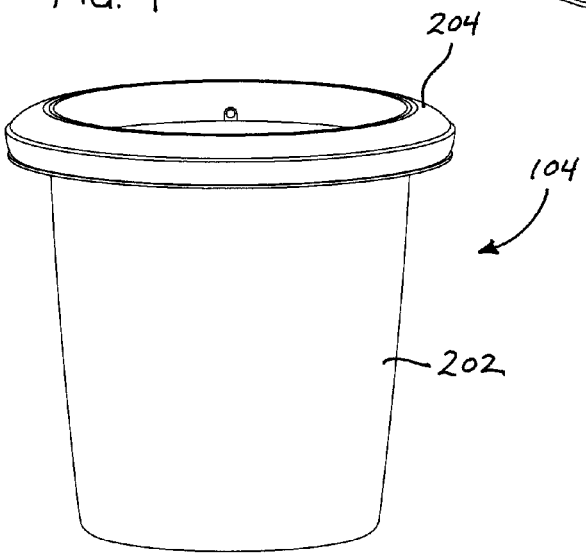

LATCH ASSEMBLY FOR A VACUUM SYSTEM

FIELD OF THE INVENTION

The present invention relates to a latch assembly for coupling a dirt receptacle to a vacuum cleaner housing. The invention finds particular utility in central vacuum cleaner systems. Other embodiments may be used other vacuum cleaner systems, such as upright vacuum cleaners, commercial vacuums, wet extractors, stick vacuums, canister vacuums, and the like.

BACKGROUND OF THE INVENTION

Vacuum cleaning systems are the preferred method of cleaning carpeted and hard floors and other areas. These devices are manufactured in a variety of configurations including central, canister, upright, power wands, power heads, handhelds, etc. These different vacuum types differ in many design features such nozzle size and configuration, floor agitation systems, cyclonic airflow and advanced dust filtering, however, they all typically share various components. Portable vacuum cleaner systems are popular because they permit great flexibility in where they may be used, can be relatively inexpensive, and are portable from dwelling to dwelling. Nevertheless, due in part to the inconvenience of manipulating an entire vacuum cleaning system, and also the power, weight and size limitations of the typical portable vacuum systems, central vacuum systems are often used.

Central vacuum systems use a central power unit which may have a relatively high-power vacuum motor and large dirt container. Such central vacuums are typically located outside of the main living area of a home, such as, for example, in a garage, basement, attic, etc. A network of conduits hidden below floorboards, above ceilings and between walls connects wall-based vacuum outlets to the central power unit. The power unit is usually connected to a dedicated 15 amp or larger power circuit and may run on 240 and 120 volt alternating current power (AC), but power requirements may vary depending on the characteristics of the local power system or system requirements. By isolating the powerful vacuum motor outside of the primary living area, the homeowner is able to enjoy strong suction power not typically available in conventional integrated vacuum cleaning devices without having to hear the noise that such a high power vacuum motor generates and without having to physically manipulate such a unit. Typically, central vacuum systems are equipped with one or more hose/cleaning attachment modules that connect to vacuum outlets located throughout the house. In addition to providing an airflow path from the cleaning attachment to the dirt canister and vacuum motor, these wall connectors may provide a power connection to operate active components of the cleaning attachments and permit the user to turn the vacuum unit on and off. U.S. Pat. No. 5,400,463 illustrates an example of a central vacuum system. This patent is incorporated herein by reference in its entirety.

Though central vacuum systems differ from portable vacuum systems in that they are typically more robust and are built into the house, their basic design has many similarities with conventional portable vacuums. One common feature is a dirt container or bucket to hold captured dirt and debris. In a central vacuum, the dirt container typically is located with the central power unit that houses the vacuum motor. The dirt container may be removably attached to and form the lower section of the central power unit. Similar dirt receptacles are sometimes employed in portable vacuum cleaner systems, such as upright and canister vacuums, but the dirt container on a central vacuum system generally is larger than the container on a portable system. The dirt container may contain a bag or other filter (such as a pleated filter), or it may simply receive dirt separated by a filter or an inertial and/or cyclonic separation system. Of course, combinations of cyclones or inertial separators and bags and filters are also possible. Nevertheless, the manner in which the dirt is separated from the airflow is not particularly relevant to the invention described herein. Vacuum cleaner dirt containers usually are detachable from the rest of the system to allow the user to empty accumulated dust and dirt, but in some cases they may be permanently installed and emptied using a trapdoor or other opening. In either event, but particularly where the container is emptied by removing it, the container may have some form a mating assembly to connect the container to the vacuum cleaner and lock it in place. In typical central vacuum cleaners, an over-center strap latch is used to attach the dirt container to the central unit.

the weight of the container while aligning it and latching it in place. Such latches also may be difficult to operate while removing the dirt container, creating a risk that the user will drop the heavy, filled container. These design drawbacks may lead to damage or failure of the attachment assembly, and inconvenience to the user. Other problems and drawbacks may exist with known systems.

SUMMARY OF THE INVENTION

In one exemplary embodiment, there is provided a central vacuum cleaner with a housing having a vacuum fan and a fan motor therein and a dirt container removably mounted to a lower end of the housing. The dirt container has a receptacle having a closed bottom wall, a sidewall extending upward from the bottom wall, and an open top. A ring mount extends from the receptacle sidewall near to the open top of the receptacle and extends substantially around an entire perimeter of the sidewall. A bottom side of the ring mount is shaped to be held by an operator to support the dirt container. A release ring is movably mounted above the ring mount and extends substantially around the entire perimeter of the sidewall. One or more locks are mounted between the ring mount and the release ring, and are movable by the release ring from an engaged position in which the one or more locks extend towards and engage the lower end of the housing to hold the dirt container to the housing to a disengaged position in which the one or more locks retract from the lower end of the housing to permit removal of the dirt container from the housing.

In another exemplary embodiment, there is provided a central vacuum cleaner with a housing having a vacuum fan and a fan motor therein and a dirt container removably mounted to a lower end of the housing. The housing has one or more detents formed substantially around an entire perimeter of the lower end. The dirt container has a receptacle having a closed bottom wall, a sidewall extending upward from the bottom wall, and an open top. A ring mount extends from the receptacle sidewall near to the open top of the receptacle and extends substantially around an entire perimeter of the sidewall. A bottom side of the ring mount is shaped to be held by an operator to support the dirt container. A release ring is movably mounted above the ring mount and extends substantially around the entire perimeter of the sidewall. A number of locks are operatively associated with the dirt container and movable by the release ring from an engaged position in which the locks engage the detent to hold the dirt container to the housing to a disengaged position in which the locks retract from the detent to permit removal of the dirt container from the housing.

In another exemplary embodiment, there is provided a central vacuum cleaner with a housing having a vacuum fan and a fan motor therein and a dirt container removably mounted to a lower end of the housing. The dirt container has a receptacle having a closed bottom wall, a sidewall extending upward from the bottom wall, and an open top. A number of locks are arranged around a perimeter of the receptacle and configured to move towards the lower end of the housing to an engaged position lock the dirt receptacle to the housing, and away from the lower end of the housing to a disengaged position to unlock the dirt receptacle from the housing. A single operative member adapted to simultaneously move the plurality of locks from the engaged position to the disengaged position.

It will be understood that the foregoing summary of the invention is provided for illustrative purposes only, and is not intended to modify or narrow the scope of the claims in any way.

BRIEF DESCRIPTION OF THE DRAWINGS

The present inventions are described in detail with reference to the exemplary embodiments shown in the following figures, in which like parts are designated by like reference numerals.

FIG. 2 is an exemplary embodiment of a dirt container shown detached from the bottom of an upper housing.

FIG. 3 is a top view of the exemplary dirt container of FIG. 2.

FIG. 4 is a front view of the exemplary dirt container of FIG. 2.

DETAILED DESCRIPTION OF EMBODIMENTS OF THE INVENTIONS

The present disclosure provides a latch feature for vacuum cleaners. An exemplary embodiment of such a feature is described with reference to one exemplary use in a central vacuum cleaner, such as the central vacuum shown in FIG. 1, to secure a dirt container to a power unit. It will be appreciated, however, that latches having different specific structures may be used, and other uses for such latches may be used in various other contexts. For example, embodiments of latches can be used with upright vacuums, canister vacuums, stick vacuums, portable and handheld vacuums, shop vacuums, wet extractors, and so on. Furthermore, the various features described herein may be used separately from one another or in any suitable combination. The present disclosure illustrating an exemplary embodiment is not intended to limit the invention in any way.

Figure 1:
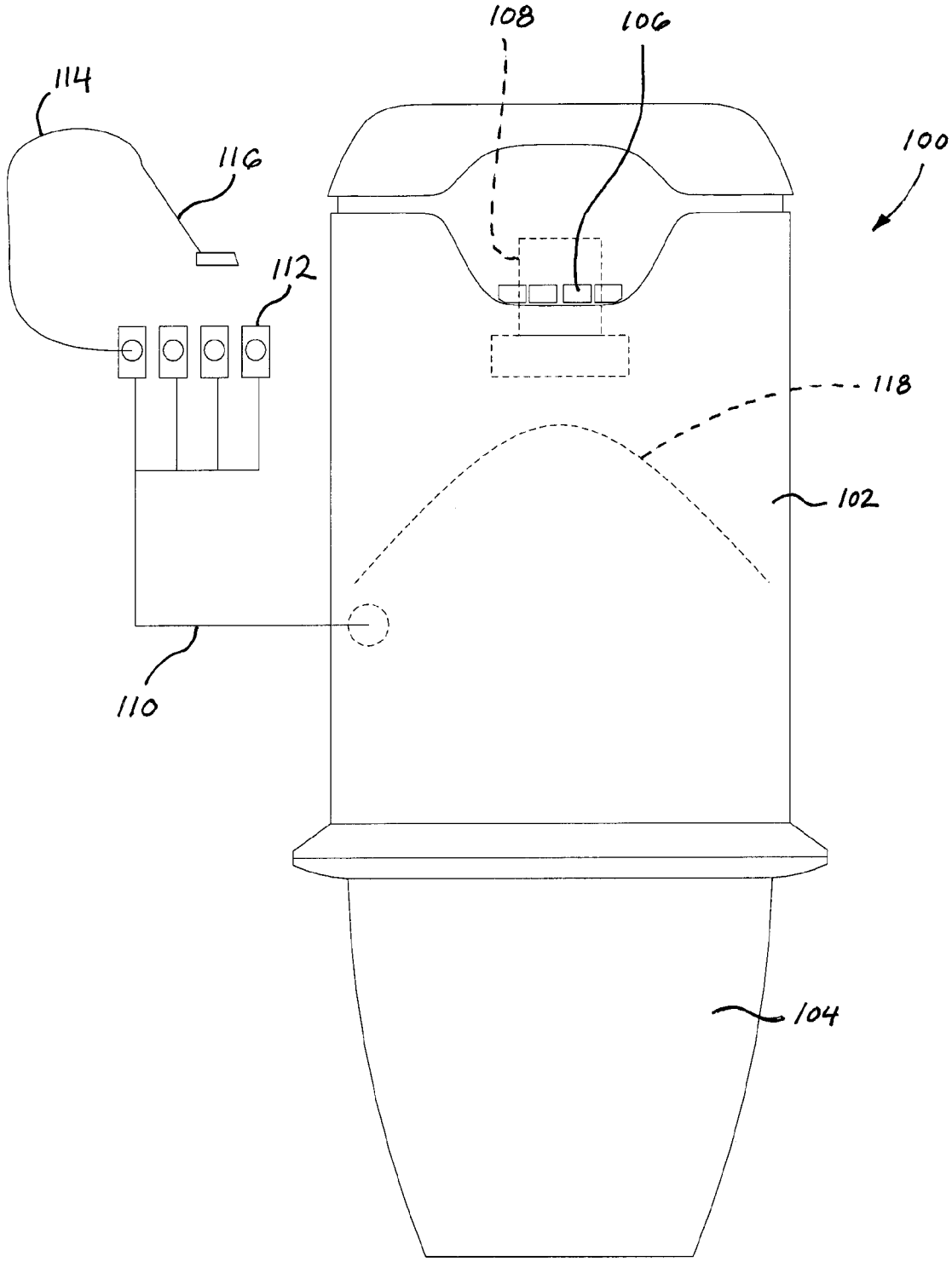
FIG. 1 is a schematic of an exemplary central vacuum system.

FIG. 1 illustrates an exemplary central vacuum unit 100 in which embodiments of the invention may be used. The central vacuum unit generally includes an upper housing 102 containing various operating parts, and a dirt container 104 connected to the bottom of the upper housing 102. The upper housing 102 may include various operating components, such as control electronics 106 and a fan/motor unit 108 having a suction fan and electric drive motor, as known in the art. In the shown embodiment, the upper housing 102 is fluidly connected to a system of inlet pipes 110. These pipes 110 are routed through a building to one or more outlets 112. The outlets 112 are adapted to connect to a suction hose 114, which, in turn, is connected to a cleaning head 116 or other implement to direct suction generated by the fan/motor unit 108. A bag 118 may be provided in the upper housing 102 to intercept dirt and debris carried to the upper housing 102 through the hose and pipes. Numerous variations on the foregoing parts are known in the art. For example, the bag 118 may be replaced by or supplemented with a cyclone separator or other filters. These and other variations may be used in alternative embodiments, and the specific details of the motor, motor controls, fluid conduit system and separation system do not form a substantive part of the present invention.

An exemplary dirt container 104 is shown in more detail in FIGS. 2-4. The exemplary dirt container 104 includes a bucket-shaped dirt receptacle 202 having vertically-extending sidewalls, an open top, and a closed bottom. The dirt container 104 is oriented vertically below the upper housing 102. As used herein, the term "vertical" generally refers to the global vertical direction, which is generally oriented with the above/below arrangement of the upper housing 102 and dirt receptacle 104, and along an axis extending from the geometric center of the bottom of the dirt container 104 to the geometric center of the open top of the dirt container 104. The term "horizontal" generally refers to the global horizontal plane, or a plane relative to which the "vertical" direction is generally orthogonal. One or more portals may be formed in the sidewalls or bottom. For example, an access door may be provided in the sidewall, or a trapdoor may be provided through the bottom. The receptacle 202 may be made of any suitable material, such as metal or plastic, and may be transparent or include transparent portions to provide a view of its contents while it is attached to the upper housing 102. As shown in FIG. 3, the receptacle may have a generally circular cross section as viewed along the vertical axis, but other shapes (e.g., ovate, rectangular, etc.) are possible.

A latch assembly 204 is provided at or near the top of the receptacle 202. The latch assembly 204 is used to connect the dirt container 104 to the upper housing 102. The bottom end of an exemplary upper housing 102 is shown in FIG. 2. The bottom 206 of the upper housing 102 includes an opening or movable door through which dirt and debris is dropped for collection in the dirt container 104. As noted above, any suitable separation system may be used to remove the dirt from the airflow, such as a cyclone, bag or other filter. In some cases, the dirt container 104 itself may form part of a separation system. This may be the case, for example, where a cyclonic airflow is generated within the dirt container 104. Furthermore, physical parts of a separation system may extend down into the dirt container 104. For example, a central cone of a tapered cyclone or a filter may extend into the dirt container. As shown in FIG. 2, the bottom of the upper housing 102 may include a short tapered (e.g. frustoconical) section 208, a detent bead 210, and a seal 212, the purposes of which are described subsequently herein.

Figure 5:
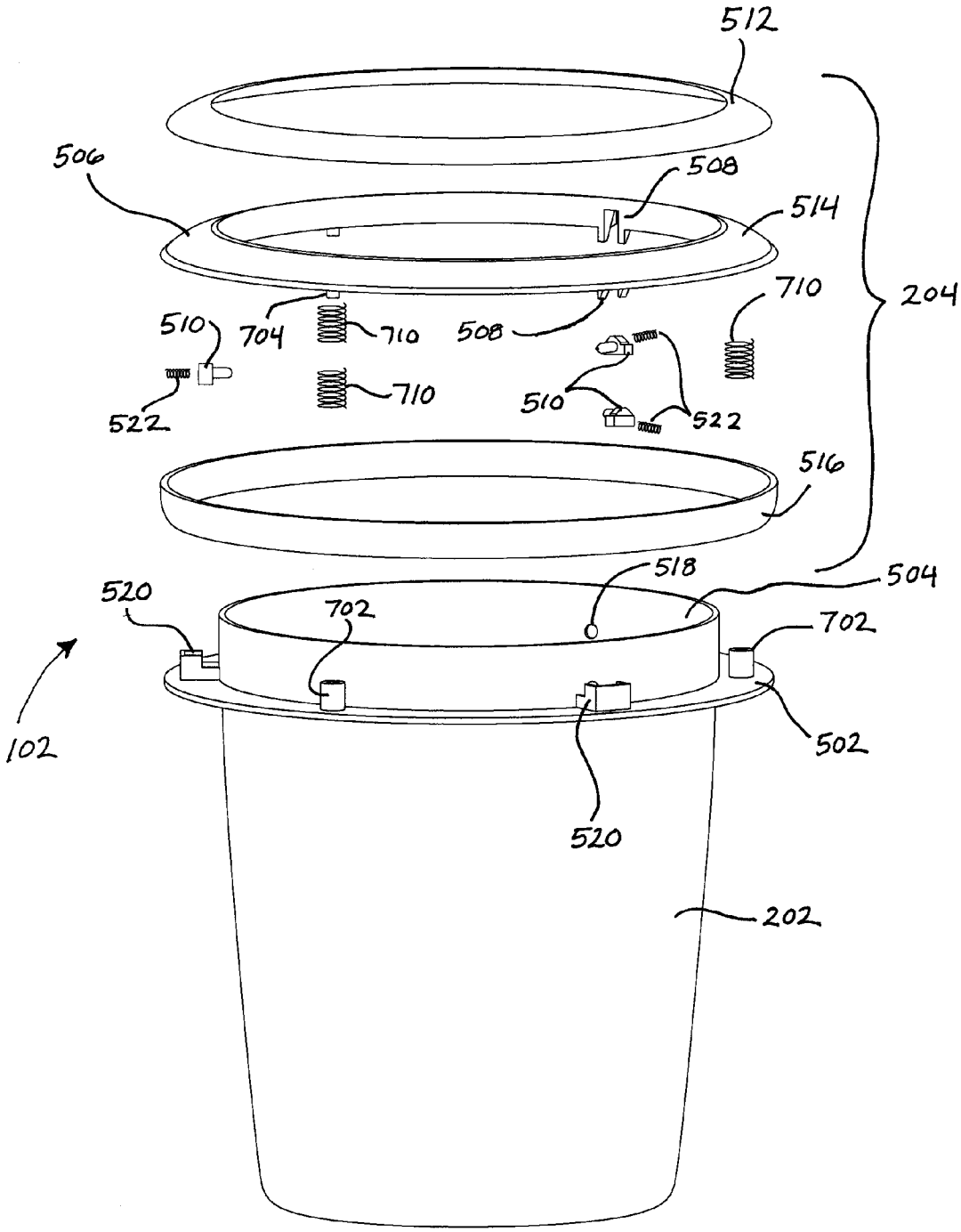
FIG. 5 is an exploded view of the exemplary dirt container of FIG. 2.

The exemplary dirt container 104 is shown in exploded view in FIG. 5. In this embodiment, the receptacle 202 includes a ring mount 502 formed as a generally radially-extending wall near the open upper 504 end of the receptacle 202. The ring mount 502 may be integrally molded with the receptacle 202, or made as one or more separate parts and attached thereto. Also, the ring mount 502 may extend all the way around the perimeter or circumference of the receptacle 202, as shown, or it may include interruptions or have other configurations. The bottom of the ring mount 502 may be contoured to aid with gripping it during removal and installation of the dirt container 104 on the upper housing 102.

The exemplary latch assembly 204 may be secured to the ring mount 502, and include a release ring 506 by which an operator can control the connection of the dirt container 104 to the upper housing 102. In the shown embodiment, the release ring 506 includes lock actuators 508 that are adapted to disengage corresponding locks 510 to disconnect the dirt container 104. Three lock actuators 508 and corresponding locks 510 are shown in FIG. 5, but more or fewer of these parts may be used in other embodiments.

The release ring 506 may include additional features, such as a reinforcement 512 or a skirt gasket 516. The reinforcement 512 in the shown embodiment may be a rigid part that helps distribute forces applied to the release ring 506 to help ensure that the release ring 506 does not flex during actuation. An exemplary reinforcement 512 may be a thin steel ring that is positioned on the upper surface of the release ring 506. Such a reinforcement ring may extend all the way around the release ring 506, but it may be interrupted at points, or provided only where reinforcement of the underlying structure is found to be desirable. The shown reinforcement 512 is recessed in a correspondingly-shaped channel 514 formed in the upper surface of the release ring 506 to provide a smooth upper surface (see, e.g., FIGS. 6-7) and attractive aesthetic appearance, but this is not required in all embodiments.

The exemplary skirt gasket 516 is provided between the release ring 506 and the ring mount 502, and may be mounted to the release ring 506 or the ring mount 502, or simply captured in place. In the shown embodiment, the skirt gasket 516 is connected to the bottom of the release ring 506. The skirt gasket 516 is provided to help prevent dust and dirt, an operator's fingers, or other objects from moving between the release ring 506 and the ring mount 502, or simply to enhance the aesthetic appearance of the device. Any suitable material may be used for the skirt gasket 516. For example, where the skirt gasket 516 is intended to deform during use, it may be made of a rubber, fabric, flexible polymer or other deformable material, but where it does not deform, it may comprise a simple extension of the release ring 506 or reinforcement 512 (if one is provided). The operation of an exemplary skirt gasket 516 is described in detail subsequently herein.

Figure 7:
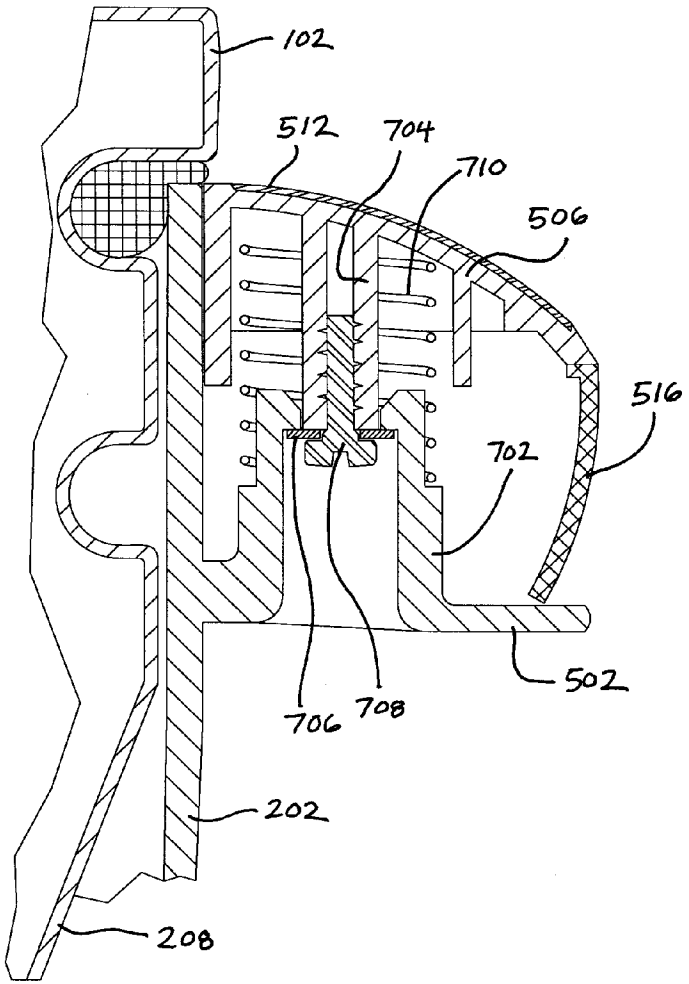
FIG. 7 is a cutaway view of an exemplary latch retainer arrangement provided on the exemplary dirt container of FIG. 2.

Referring now to FIGS. 5 and 7, an example of how the release ring 506 may be connected to the ring mount 502 is described in detail. In the exemplary embodiment, the release ring 506 may be connected to the ring mount 502 by telescoping connectors that permit relative vertical movement between the release ring 506 and ring mount 502, but limit movement in other directions. Each telescoping connector may include a first telescoping member 702 on the ring mount 502 and a second telescoping member 704 on the release ring 506. The telescoping member 702, 704 are shaped such that one is telescopically received in the other to permit relative axial movement, but little or no movement in other directions. In the shown embodiment, both members 702, 704 are formed as cylinders, and the first telescoping member 702 surrounds the second telescoping member 704. FIG. 7 shows the two members 702, 704 in their fully-extended position. To prevent complete separation of the release ring 506 from the ring mount 502, the second telescoping member 704 may be captured in place inside the first telescoping member 702 by a washer 706 that is secured to the second telescoping member 704 by a screw 708. This washer engages a shelf that extends radially inward from the inner wall of the first telescoping member 702. One or more release ring springs 710 may be provided to resiliently bias the release ring 506 upwards away from the ring mount 502, to prevent inadvertent disconnection of the dirt container 104 and reset the release ring 506 to the locking position when it is not being depressed. In the shown embodiment, one such spring 710 surrounds each of the first telescoping members 702. The springs 710 are shown as coil springs, but other kinds of resilient member, such as resilient foams, leaf springs, and the like may be used. For example, the springs 710 may be replaced by cantilevered extensions rising from the ring mount surface that bias the release ring 506 upwards, or the springs 710 may be provided as an integral part of the skirt gasket 516 where the gasket 516 is a resilient member located between the release ring 506 and ring mount 502. Three telescoping mounts and corresponding springs are provided as an example in the shown embodiment. Other numbers, shapes and arrangements of telescoping members, structures to limit their separation, and resilient biasing devices are possible in other embodiments, as will be appreciated by persons or ordinary skill in the art in view of the present disclosure.

As noted above, the release ring 506 may operate one or more locks 510 that hold the dirt container 104 to the upper housing 102. An example of one such lock 510 is shown in two slightly different cross-section views provided in FIGS. 6 and 8A-8D. The view in FIG. 6 is a side cross-section view that passes through a center of the lock, and the views of FIGS. 8A-8D are non-cutaway side views of the lock arrangement.

Figure 6:
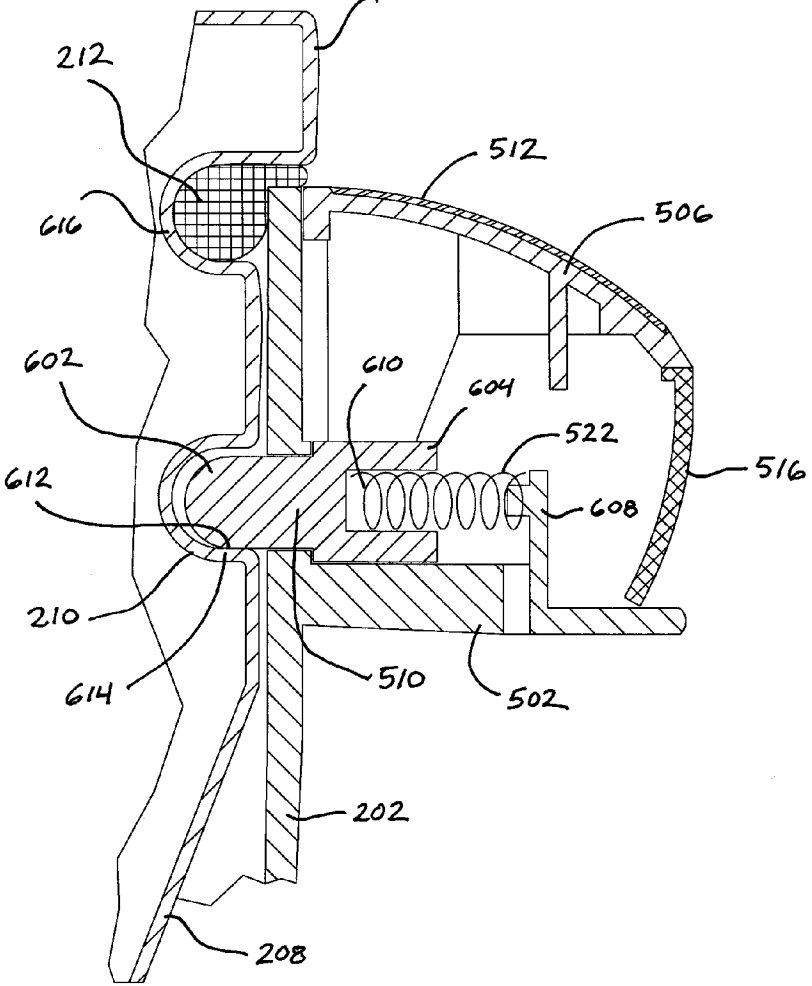
FIG. 6 is a cutaway view of an exemplary latch arrangement provided on the exemplary dirt container of FIG. 2.

As shown in FIG. 6, an exemplary lock 510 may include a locking pin 602 that extends from a lock body 604. The lock 510 may be mounted with the locking pin 602 protruding through a corresponding pin hole 518 that passes through the receptacle 202. The lock body 604 may be mounted such that it can slide axially generally along the length of the pin 602, to thereby vary the distance the locking pin 602 protrudes through the pin hole 518. For example, the lock body 604 may be mounted in a lock mount 520 having a generally open box-like shape that extends upwards from the upper surface of the ring mount 502. As shown in FIG. 5, the lock mount 520 is positioned adjacent the corresponding pin hole 518. The lock mount 520 may form a track in which the lock 510 can slide in a generally radial direction relative to the receptacle 202 wall. The lock mount 520 may have a back wall 608 located a sufficient radial distance from the pin hole 518 to permit the lock 510 to be installed in the lock mount 520 and to permit the desired amount of sliding movement. As best shown in FIG. 6, a lock spring 522 may be positioned between the lock 510 and the back wall 608 to bias the lock 510 radially inward. In this example, the lock spring 608 is a coil spring that may fit in a recess 610 formed in the back of the lock 510, but other kinds of spring or resilient devices may be used in this or other locations. In other embodiments, the lock spring 522 may be omitted and replaced by a moving wedge or other member that drives the lock into the engaged position as the release ring 506 moves upwards under the restoring force of its own return springs 710.

Still referring to FIG. 6, in the exemplary embodiment, the locking pin 602 extends out of the pin hole 518 and into engagement with a detent 210 formed near the bottom of the upper housing 102. In the shown embodiment, the detent 210 is formed as a detent bead that extends all the way around the upper housing 102. Thus, the locking pin 602 can engage the detent 210 regardless of the angular orientation between the dirt container 102 and the upper housing 102. In other embodiments, the detent 210 may comprise a bead that extends partly around the housing, which might limit the ability to engage the parts at particular orientations but still be useful. In still other embodiments, the detent 210 may be a simple hole, such as a round hole punched through the upper housing wall. In this embodiment, it may be necessary to orient the dirt container 104 at a particular angle relative to the upper housing 102 to connect the parts. This may be advantageous where the dirt container 104 includes functional features, such as airflow members that work in conjunction with related members in the upper housing 102, or under other circumstances. While no arrangement is necessarily required, the use of a continuous detent bead 210 has been found to provide a particularly useful arrangement that eases the operator's burden when connecting the parts because the operator need not consider the angular orientation of the parts. In such an embodiment, the upper housing 102 and dirt container 104 may have a circular cross sectional profile, as viewed along the vertical axis, to permit orientation at any angle.

In the shown exemplary embodiment, the locking pins 602 extend into the detent 210 a sufficient distance to hold the dirt container 104 (and any dirt accumulated therein) in engagement with the upper housing 102 during operation of the central vacuum 100. The upper housing 102 (or dirt container 104) may include one or more seals 212 to provide an airtight or leak-resistant connection between the dirt container 104 and the upper housing 102. For example, the shown seal may comprise a resilient rubber, polymeric or felt ring that is retained in a seal groove 616 on the upper housing 102. Such seals are known in the art and need not be described in detail herein.

In the exemplary embodiment, a generally horizontal portion 612 of the pin 602 may contact a generally horizontal portion 614 of the detent 210. In this position, the weight of the dirt container 104 and its contents are transferred to the top of the pin 602, which operates in single shear to convey that load to the lower wall of the detent 210 to hold the dirt container 104 on the upper housing 102. Of course, other embodiments of lock arrangements may have different load-transferring and load bearing arrangements, and the present embodiment is not intended to be a limiting example. Providing the contacting generally horizontal surfaces 612, 614 helps prevent accidental disengagement, but some amount of angle between these parts may be tolerable, provided the dirt container 104 generally does not unexpectedly detach during normal operation.

Wear caused by friction, plastic deformation caused by point loads and other factors may be considered when constructing embodiments of the lock arrangement, and addressed as known in the art to prevent excess wear or failure of the parts. If desired, the pin 602, detent 210, and portions of the dirt container 104 surrounding the pin 602 may be made of relatively strong materials or suitably reinforced. For example, the detent 210 may comprise rolled and formed sheet steel. As another example, the pin may comprise a steel or magnesium alloy that may be impregnated with lubricant or coated or otherwise treated to reduce friction, fusion or adherence caused by oxidation (rusting) of the parts at their contact points. As yet another example, the portions of the dirt container 104 surrounding the pin hole 518 may be thickened to help support the weight of the dirt container 104 and collected dirt, and particular attention may be given to the portion of the wall above the pin hole 518 to help prevent wear, damage, or failure at that point. Finally, if wear is determined to be a concern, or if adjustment during or after fabrication is desirable, the locks 510 or detent(s) 210 may be movably mounted to permit some vertical adjustment. For example, the detent 210 may be provided on a vertically-adjustable band, or the locks 510 may be mounted on shims or on vertically-movable lock mounts 520.

Referring to FIGS. 8A-8D, the lock 510 may include any suitable structure or mechanism to retract the locking pin or pins. In the shown exemplary embodiment, the release ring 506 includes a first release member 802 that that extends down towards the ring mount 502. The first release member 802 is positioned to contact a corresponding second release member 804 formed on the lock 510. In this example, the first and second release members 802, 804 are provided as corresponding angled wedges. The first release member 802 tapers from a narrow end at the bottom to a wider end at the top, forming an angled surface that is inclined away from the radial center of the dirt container 104. The second release member 804 has a wider bottom end that tapers to a narrower top end, forming an angled surface that faces the surface of the first release member 802, and is inclined in the same general direction. The inclined surfaces of the release members 802, 804 may be inclined at the same or different angles, and may have the same or different shapes. If desired, each release member 802, 804 may comprise a pair of wedge members that are located on opposite sides of the lock 510. In this arrangement, the two first release members 802 may form a channel between them that contains the lock 510 and prevents it from moving perpendicular to the axis of the pin 602. This arrangement also may provide a more even force to move the lock 510 backwards.

To release the dirt container 104 from the upper housing 102, the operator presses down on the release ring 506 against the restoring force provided by the release ring springs 710. The operator also may need to overcome the restoring force provided by the lock springs 522, if they are provided. In addition, it may be necessary to overcome frictional forces between the pin 602 and the detent 210 and between the pin 602 and the receptacle 202. Such forces may be generated as a result of the pins 602 being used to hold the dirt container 104 to the upper housing 102 against gravity. To overcome these frictional forces, it may be necessary for the operator to lift up on the dirt container 104, which may be beneficial in that it ensures that the locks 510 are not disengaged until after the operator is at least partially supporting the weight of the dirt container 104. If this benefit is particularly desired, the pins 602 may be provided with downward hooks or bumps on their ends to engage a corresponding raised lip on the bottom of the detent 210, which will increase the necessity to lift up on the dirt container 104 before it will be possible to press down on the release ring 506. Where it is found that overcoming the friction caused by the pins is not desirable, the pins 602, detent 210 and other parts may be lubricated or otherwise arranged to reduce or minimize friction.

It will be apparent from the foregoing that the operator should grasp or support the bottom of the ring mount 502 as he or she depresses the release ring 506, and thus it may be beneficial to provide the bottom of the ring mount 502 with an ergonomic shape, a lip or contour to help with holding it, or high friction surfaces to help prevent slipping. In the shown exemplary embodiment, the release ring 506 and ring mount 502 extend around the entire circumference of the dirt container 104, which provides the additional benefit that the operator can grasp the dirt container 104 from any direction and at a wide variety of locations to remove the dirt container 104. This permits the central vacuum 100 to be mounted in spaces in which many conventional devices could not be installed, because many devices locate the handles or locks at discrete and unmovable locations that must be accessible when the central vacuum is mounted to the wall. That problem may be eliminated by the exemplary embodiment, or other embodiments in which the release ring 506 and ring mount 502 extend around large portions of the dirt container 104. In either event, the provision of the large ring mount 502 and release ring 506 allows the user to simply lift the dirt container at any two locations (typically generally opposite in order to balance the load), and depress the release ring with both hands at those two locations to remove the dirt container 104.

Figure 8A:
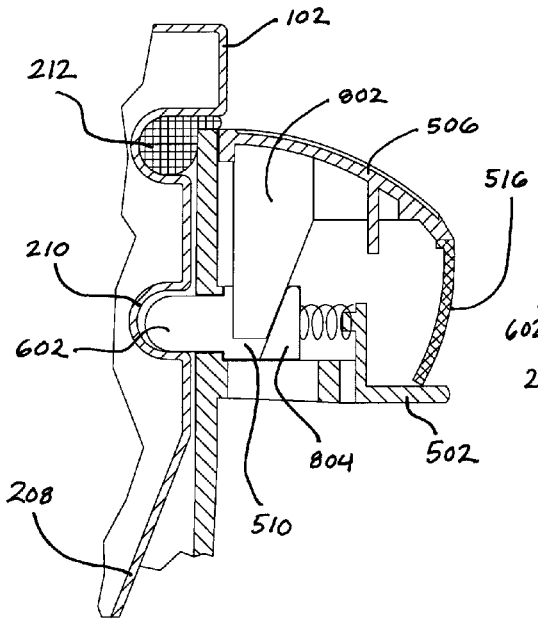
FIGS. 8A-8D are cutaway side views of the exemplary latch arrangement of FIG. 6, shown in the locked, unlocked, partially-removed and removed positions, respectively.
Figure 8B:
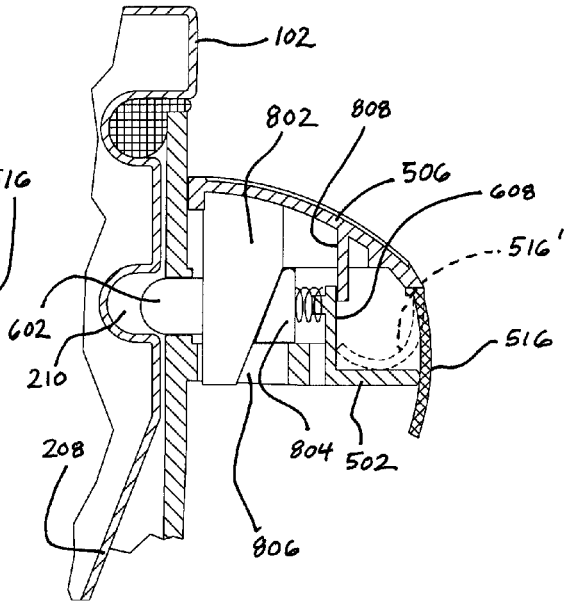

As shown in FIG. 8B, downward movement of the release ring 506 causes the first release member 802 to slide and press against the second release member 804. The force generated by contact between the first and second release members 802, 804 drives the lock 510 against the lock spring 522, and pushes the lock 510 backwards in a radial direction away from the upper housing 102. A downwardly-depending wall 808 formed on the bottom of the release ring 506 may be provided to move behind the back wall 608 to support it against flexure during he release operation. As the lock 510 moves back, the locking pin 602 retracts partially or completely from the detent 210. Variations to the exemplary arrangement will be apparent to persons of ordinary skill in view of the present disclosure. For example, the first and second release members 802, 804 may be shapes other than wedges, such as by making one a curved ramp and the other a round pin or roller that rides on the ramp, or by simply making one or the other a square block against which a wedge or ramped surface presses. Other devices or mechanism for moving the locks may be used as well.

Figure 8C:
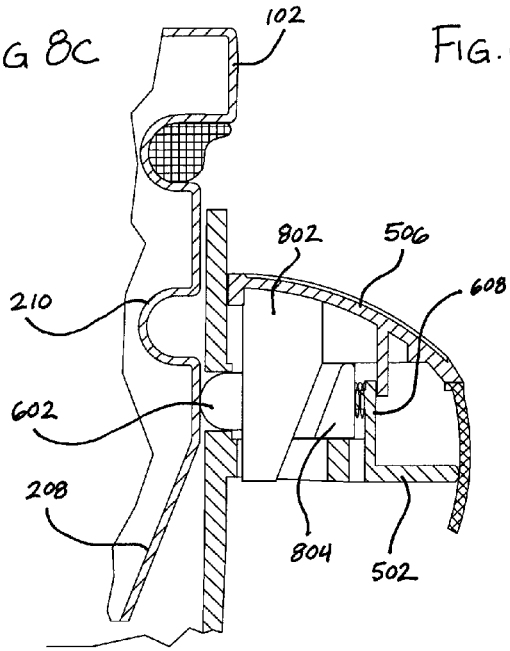

FIG. 8B shows the exemplary release ring 506 in the fully depressed position. At this point, contact between the release ring 506 and other parts prevents further movement. As shown, the ring mount 502 may include an opening 806 to receive the bottom end of the first release member 802. In this position, the pin 602 may be fully retracted from the detent 210, or, as shown, the pin 602 may still protrude some distance into the detent 210. In the latter case, the pin 602 and/or detent 210 may include ramped or curved surfaces that contact one another to continue pressing the pin 602 out of engagement with the detent 210 as the dirt container 104 is lowered. For example, the pin 602 may have a ramped, curved or hemispherical end that protrudes into the detent 210, and the lower lip of the detent 210 may be curved or ramped as well. Contact between these surfaces, in combination with the operators' lowering of the dirt container 104, is sufficient to drive the pins 602 completely out of engagement with the detent 210, as shown in FIG. 8C. To permit this movement, the locks 510 should be spaced a short distance from the back wall 608 when the release ring 506 is fully depressed, so that contact between the curved or ramped surfaces of the pin and/or detent can push the lock 510 back an additional distance to release the dirt container 104.

Figure 8D:
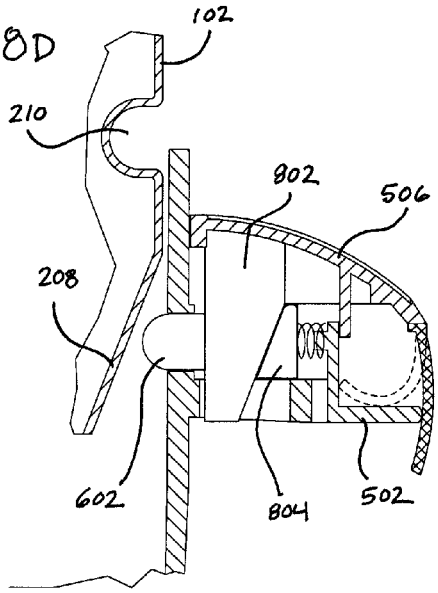

FIG. 8D shows the dirt container 104 fully released from the upper housing 102. The dirt container may now be emptied or inspected and reinstalled on the upper housing 102. To reinstall the dirt container 104, the operator may generally reverse the process described above. To facilitate reinstallation, the upper housing 102 may include a short tapered section 208, which will force the pins 602 back as the dirt container 104 is lifted into contact with the upper housing 102. The tapered section may also assist with aligning the dirt container 104 with the upper housing 102. In the shown embodiment, the provision of the tapered section 208 may eliminate the need for the operator to depress the release ring 506 during reinstallation. For example, the tapered section 208 may press the locks 510 back to permit upwards movement of the dirt container 104. In this embodiment, it is not necessary for the operator to depress the release ring 506 because the locks 510 can move backwards independently of the position of the release ring 506. In alternative embodiments, such as an embodiment in which ramps on the release ring move the locks into the engaged position, it may be necessary to depress the release ring 506 during installation.

FIG. 8B also depicts two alternative embodiments of the operation of the exemplary skirt gasket 516. In one alternative, the skirt gasket 516 is extends around and passes below the ring mount 502 when the release ring 506 is pressed downward. In this embodiment, the skirt gasket 516 may be made of a rigid material and have a diameter that is larger than the ring mount's diameter. Alternatively, the skirt gasket 516 may be a flexible material so that it does not unduly interfere with the operators hand as the release ring 506 is pressed down. A flexible skirt gasket 516 may have a larger diameter than the ring mount 502, or it may be the same diameter or smaller and be configured to flex around the ring mount 502. In the alternative shown embodiment the skirt gasket 516' may flex under the release ring 506, and not pass under the ring mount 502. Of course, in practice and after time and wear, a flexible skirt gasket 516 may exhibit properties that change, and may change, in whole or in part, from flexing beneath the release ring 506 to extending below the ring mount 502. It will also be understood, as noted above, that other kinds of skirt gasket may be used, or it may be omitted.

Other variations on the foregoing exemplary embodiments will be evident in view of the present disclosure. For example, the release ring may, instead of moving vertically with respect to the ring mount, be constructed to rotate in a horizontal plane relative to the ring mount. In such an embodiment, the first and second release members could be turned ninety degrees, and still accomplish the same result of moving the lock out of engagement with the detent. Raised tabs may be provided on the bottom of the ring mount and the top or sides of the release ring to facilitate rotating the release ring. Such an embodiment is particularly suited to a embodiments in which the dirt container is circular and constructed to mount at any angular orientation on the upper housing. As another example, the sliding locks may be replaced by rotating locks that pivot, rather than slide, into and out of engagement with the upper housing. As another example, while the foregoing embodiments describe the locks (and more specifically, their pins), as bearing the weight of the dirt container during use, the lock pins may be used only for temporary mounting of the dirt container, in which case additional latches may be provided to secure the dirt container to the upper housing during operation.

In effectuating embodiments of the invention, it may be desirable to design the parts to obtain certain additional advantages or benefits. For example, the shown exemplary embodiments use three locks to hold the dirt container to the upper housing, which is advantageous because the load of the dirt container is likely to relatively evenly distribute among three points even if there is some difference in their heights. Nevertheless, two or even one lock may be used in other embodiments, and more than three locks may be provided to provide redundancy or enhance load capacity. As another example, it may be desirable to reduce the likelihood that the dirt container can be removed using only one hand or upon an accidental application of force at a single location on the release ring. To this end, it may be possible to provide sufficient clearance in the telescoping connections between the release ring and the ring mount that applying a downward force at just one discrete location on the release ring may cause the release ring to tilt downward at the location of the force, but remain in an upward position at a location opposite the force. Thus, only the lock(s) proximal to the force may be disengaged, and the remaining locks may stay engaged to prevent the dirt container from falling. This and other exemplary benefits may be provided, but are not required in all embodiments. As another example, the release ring may be movably mounted to the sidewall of the receptacle, rather than being movably mounted directly to the ring mount.

The embodiments described herein are all exemplary, and it will be appreciated that the various features shown herein can be used separately from one another, or in various combinations, and modified and adapted in various ways and for different uses. The description of the foregoing exemplary embodiments and variations thereof are not intended to limit the scope of the claimed invention in any way. Furthermore, the claims are intended to recite only the minimum required structures, and additional structures, and even redundant structures, may be added without departing from the scope of the claims. For example, where a claim may recite that "each" of the locks includes certain features, it will be understood that this refers to features required in one set of locks, and that additional locks beyond those recited in the claims may be added without departing from the "each" language, or, stated differently, recitations such as "each" are not intended to be construed "each and every."

We claim:

1. A central vacuum cleaner comprising:

a housing having a vacuum fan and a fan motor mounted therein;

a dirt container removably mounted to a lower end of the housing to be generally positioned vertically below the housing, the dirt container comprising:

a receptacle having a closed bottom wall, a sidewall extending upward from the bottom wall, and an open top, a ring mount extending from the receptacle sidewall proximal to the open top of the receptacle and extending substantially around an entire perimeter of the sidewall, a bottom side of the ring mount being shaped to be held by an operator to support the dirt container, a release ring movably mounted above the ring mount and extending substantially around the entire perimeter of the sidewall, and one or more locks mounted between the ring mount and the release ring, the one or more locks being movable by the release ring from an engaged position in which the one or more locks extend towards and engage the lower end of the housing to hold the dirt container to the housing to a disengaged position in which the one or more locks retract from the lower end of the housing to permit removal of the dirt container from the housing.

2. The central vacuum cleaner of claim 1, wherein the ring mount comprises a wall extending generally in a horizontal plane below the open top of the receptacle.

3. The central vacuum cleaner of claim 1, wherein the ring mount is integrally formed with the receptacle.

4. The central vacuum cleaner of claim 1, wherein the release ring is movable with respect to the ring mount along a vertical axis.

5. The central vacuum cleaner of claim 1, wherein the release ring is movably mounted to the ring mount.

6. The central vacuum cleaner of claim 5, wherein the release ring is movably mounted to the ring mount by a plurality of telescoping members and biased in an upward direction by one or more resilient members.

7. The central vacuum cleaner of claim 1, wherein the one or more locks comprise at least three locks.

8. The central vacuum cleaner of claim 7, wherein the at least three locks are simultaneously movable from the engaged position to the disengaged position by applying a downward force on the release ring at two generally opposite locations around the perimeter of the dirt container.

9. The central vacuum cleaner of claim 1, wherein the one or more locks engage one or more detents on the housing when the one or more locks are in the engaged position.

10. The central vacuum cleaner of claim 9, wherein the one or more detents comprise a single detent extending substantially around an entire perimeter of the housing.

11. The central vacuum cleaner of claim 1, wherein each of the one or more locks comprises a lock body slidably mounted on the ring mount to move in a direction generally perpendicular to the receptacle sidewall at the location of the lock and a locking pin extending from the lock body through an opening through the receptacle sidewall, the locking pin extending into one or more detents on the housing when the lock is in the engaged position.

12. The central vacuum cleaner of claim 11, wherein the release ring comprises a first release member associated with each of the one or more locks, and each of the one or more locks comprises a second release member, the first release member comprises a first surface adapted to contact the respective second release member to move the respective lock to the disengaged position in which the locking pin is at least partially withdrawn from the one or more detents.

13. The central vacuum cleaner of claim 12, wherein the one or more locking pins are partially withdrawn from the one or more detents in the disengaged position, and each of the one or more locking pins includes at least one associated ramp surface provided between the locking pin and the one or more detents, the ramp surface being adapted to move the locking pin fully out of engagement with the one or more detents upon vertical movement of the dirt container relative to the housing.

14. The central vacuum cleaner of claim 12, wherein the lower end of the housing comprises a tapered surface, the tapered surface being adapted move the one or more locks to permit installation of the dirt container without moving the release ring relative to the ring mount.

15. A central vacuum cleaner comprising:

a housing having a vacuum fan and a fan motor mounted therein, the housing having a lower end and one or more detents formed substantially around an entire perimeter of the lower end;

a dirt container removably mounted to the lower end of the housing to be generally positioned vertically below the housing, the dirt container comprising:

a receptacle having a closed bottom wall, a sidewall extending upward from the bottom wall, and an open top, a ring mount extending from the receptacle sidewall proximal to the open top of the receptacle and extending substantially around an entire perimeter of the sidewall, a bottom side of the ring mount being shaped to be held by an operator to support the dirt container, a release ring movably mounted above the ring mount and extending substantially around the entire perimeter of the sidewall, and a plurality of locks operatively associated with the dirt container and movable by the release ring from an engaged position in which the locks engage the detent to hold the dirt container to the housing to a disengaged position in which the locks retract from the detent to permit removal of the dirt container from the housing.

16. The central vacuum cleaner of claim 15, wherein the dirt container and housing are aligned on a vertical axis when the dirt container is mounted to the housing, and the dirt container is mountable to the housing regardless of the angular orientation of the dirt container about the vertical axis.

17. The central vacuum cleaner of claim 15, wherein the plurality of locks comprises three or more locks, the three or more locks being simultaneously movable from the engaged position to the disengaged position by applying a downward force on the release ring at two generally opposite locations around the perimeter of the dirt container.

18. The central vacuum cleaner of claim 15, wherein the one or more detents comprise a single detent extending around an entire perimeter of the housing.

19. A central vacuum cleaner comprising:

a housing having a vacuum fan and a fan motor mounted therein;

a dirt container removably mounted to a lower end of the housing, the dirt container comprising:

a receptacle having a closed bottom wall, a sidewall extending upward from the bottom wall, and an open top, a plurality of locks arranged around a perimeter of the receptacle and configured to move towards the lower end of the housing to an engaged position lock the dirt receptacle to the housing, and away from the lower end of the housing to a disengaged position to unlock the dirt receptacle from the housing, and a single operative member movably mounted to the receptacle and adapted to simultaneously move the plurality of locks from the engaged position to the disengaged position.

20. The central vacuum cleaner of claim 19, wherein the plurality of locks each support the dirt receptacle in single shear in the engaged position.

21. The central vacuum cleaner of claim 19, wherein the plurality of locks comprises three locks.

22. The central vacuum cleaner of claim 21, wherein the plurality of locks comprises only three locks.

23. The central vacuum cleaner of claim 19, wherein the single operative member comprises a releaser ring extending substantially around an entire perimeter of the receptacle.

24. The central vacuum cleaner of claim 19, wherein the dirt container and housing are aligned on a vertical axis when the dirt container is mounted to the housing, and the dirt container is mountable to the housing regardless of the angular orientation of the dirt container about the vertical axis.

* * * * *